US009061437B2

(12) United States Patent
Brancuzský et al.

(10) Patent No.: US 9,061,437 B2
(45) Date of Patent: Jun. 23, 2015

(54) METHOD AND APPARATUS FOR GLUING WOOD PARTICLES

(75) Inventors: Zdenek Brancuzský, Jihlava (CZ); Libor Kulha, Jihlava (CZ)

(73) Assignee: Kronoplus Technical AG, Niederteufen (CH)

( * ) Notice: Subject to any disclaimer, the term of this patent is extended or adjusted under 35 U.S.C. 154(b) by 128 days.

(21) Appl. No.: 13/823,881

(22) PCT Filed: Oct. 1, 2010

(86) PCT No.: PCT/EP2010/005987

§ 371 (c)(1),
(2), (4) Date: Mar. 15, 2013

(87) PCT Pub. No.: WO2012/041353

PCT Pub. Date: Apr. 5, 2012

(65) Prior Publication Data

US 2013/0175727 A1 Jul. 11, 2013

(51) Int. Cl.

| | |
|---|---|
| ***B27N 1/02*** | (2006.01) |
| ***B27N 3/18*** | (2006.01) |
| ***B27N 7/00*** | (2006.01) |

(52) U.S. Cl.

CPC .. *B27N 7/00* (2013.01); *B27N 3/18* (2013.01); *B27N 1/02* (2013.01)

(58) Field of Classification Search

None

See application file for complete search history.

(56) References Cited

U.S. PATENT DOCUMENTS

| | | | | |
|---|---|---|---|---|
| 3,164,511 A | | 1/1965 | Elmendorf | |
| 3,930,110 A | | 12/1975 | Shoemaker et al. | |
| 4,407,771 A | * | 10/1983 | Betzner et al. | 264/115 |
| 4,831,959 A | | 5/1989 | Turner | |
| 4,937,100 A | * | 6/1990 | Lanters et al. | 427/212 |
| 5,093,058 A | | 3/1992 | Harmon et al. | |
| 5,188,785 A | * | 2/1993 | Bauer et al. | 264/115 |
| 5,755,917 A | * | 5/1998 | Barnes | 156/296 |
| 6,197,236 B1 | * | 3/2001 | Oldemeyer et al. | 264/115 |
| 6,365,077 B1 | * | 4/2002 | Pott et al. | 264/113 |
| 6,451,115 B1 | | 9/2002 | Wilson | |
| 8,007,698 B2 | * | 8/2011 | Baxter et al. | 264/83 |
| 2005/0263917 A1 | * | 12/2005 | Benedetti | 264/40.4 |

(Continued)

FOREIGN PATENT DOCUMENTS

| | | |
|---|---|---|
| CA | 2 281 388 A1 | 3/2001 |
| DE | 19 28 007 A1 | 12/1970 |

(Continued)

OTHER PUBLICATIONS

International Search Report for PCT/EP2010/005987 dated May 26, 2011.

Office Action issued in corresponding Russian Application No. 2013116369 dated Oct. 10, 2014.

*Primary Examiner* — Mary F Theisen

(74) *Attorney, Agent, or Firm* — Sughrue Mion, PLLC

(57) ABSTRACT

A method and an apparatus for gluing wood particles, in particular wood strands, is described, as well as a method for the manufacturing of lignocellulosic products, in particular chip boards, oriented strand boards or fiber boards. Since the wood particles are blended in a blending device with a water-curable binder, in particular with polymeric diphenylmethane diisocyanate and moisture is added to the wood particles outside the blending apparatus, curing of the binder inside the blending apparatus, and as a consequence pollution thereof, can be avoided. Moreover, moisturizing outside the blending device can produce a particular even distribution of moisture.

26 Claims, 4 Drawing Sheets

(56) References Cited

U.S. PATENT DOCUMENTS

Figure 1:
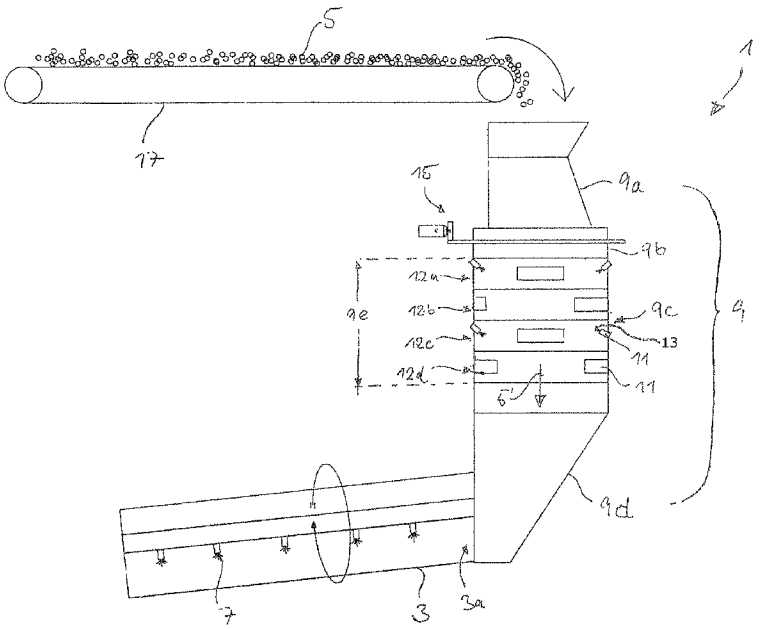

| | | | | |
|---|---|---|---|---|
| 2006/0240139 | A1* | 10/2006 | Huber | 425/447 |
| 2007/0074831 | A1* | 4/2007 | Winterowd et al. | 162/71 |
| 2009/0264560 | A1* | 10/2009 | Warnes et al. | 524/13 |

FOREIGN PATENT DOCUMENTS

| | | | |
|---|---|---|---|
| DE | 30 49 555 | A1 | 7/1982 |
| RU | 2139184 | C1 | 10/1999 |
| RU | 2164870 | C2 | 4/2001 |

* cited by examiner

METHOD AND APPARATUS FOR GLUING WOOD PARTICLES

CROSS REFERENCE TO RELATED APPLICATIONS

This application is a National Stage of International Application No. PCT/EP2010/005987 filed Oct. 1, 2010, the contents of which are incorporated herein by reference in their entirety.

The invention relates to a method and an apparatus for gluing wood particles, in particular wood strands, and to a method for the manufacturing of lignocellulosic products, in particular chip boards, oriented strand boards or fiber boards, by using the gluing method of the invention.

Lignocellulosic material production processes in general, and oriented strand boards (OSB) production processes are known in the art. U.S. Pat. No. 3,164,511 describes the OSB production process in general and, in particular, the production process with synthetic resin and protein binders and an embodiment where these binders are substituted by inorganic cement. If the strands contain less than the optimum amount of moisture, moisture may be sprayed on the strands before adding the cement. Conventional mixing equipment, such as a rotary concrete mixer, may be utilized to coat the wet strands with cement.

CA 2281388, U.S. Pat. No. 4,831,959 and U.S. Pat. No. 6,451,115 show various aspects of blenders used in the production OSB. Such blendes are commonly types of rotating drums where the various ingredients for the binder and also wax emulsions are mixed with the wooden particles to be pressed later in the process. In current production facilities with water curing binders such as isocyanate adhesives the first ingredient added into such a blender is water, followed by the actual resin and then by other ingredients such as a wax emulsions, preservatives or the like.

The sequence of addition and dosage of the various components of an adhesive system, which may include the adhesive itself, water, paraffin/wax emulsion, hardeners or accelerators, and the like, can be very different. As for the one example of adhesives based on isocyanates like pMDI (polymeric diphenylmethane diisocyanate) the first ingredient added into such a blender is water, followed by the isocyanate adhesive and then by other ingredients such as a paraffin/wax emulsions, preservatives or the like.

Especially for adhesives with water as one component of the hardening adhesive resin, the addition of water at the more or less same moment as the adhesive is added and especially within the same blending device at the same time has two significant drawbacks:

Firstly, it pollutes the blender and its internal installations such as walls, nozzles and the like by such consecutive spraying, whereby nevertheless water and adhesive are present in the blender in sprayed form at the same time. Thus, the water begins to cure the binder immediately. As a consequence the production must be halted intermittently and the blender must be cleaned at high cost to remove the partially already hardened binder from the blender and the internal installations thereof, as described in U.S. Pat. No. 4,831,959.

Secondly, the consecutive spraying of water and water curable binder in the blender of the prior art does not allow for the essentially even distribution of moisture. Such an even distribution is very necessary in order to avoid blistering during the successive pressing process, because uneven distribution of moisture and binder may cause vapor expansion or excessive local gas production which counteracts homogeneous binding. Often the production speed of a plant is limited by the time needed for a careful pressing process in terms of restriction of the internal gas and vapor pressure in order to avoid such blistering as described above.

It is an object of the present invention to overcome these drawbacks.

This object is achieved with a gluing method that comprises a step a) of blending the wood particles in a blending device with a water curable binder, in particular with an isocyanate, and more particularly with polymeric diphenylmethane diisocyanate, and a step b) of adding moisture to the wood particles outside the blending device. Thus, it is possible to avoid that curing of the binder is initiated by the moisture of the wood particles inside the blending device and that cured binder has to be removed from the inner installations of the blending device. As a consequence, the maintenance intervals of the blending device can be prolonged and the mean production capacity can be increased. Moreover, the moisturizing of the wood particles is not limited by the particular conditions inside the blending device. Various additives, like accelerators, hardeners or other co-reactants, but not restricted to these additives, may be present beside of the isocyanate based binder.

Although isocyanates are particularly useful for producing OSB, the binder might alternatively be an adhesive or an adhesive system based on so-called formaldehyde based condensation resins, including various co-reactants like urea or melamine or phenol or resorcinol or mixtures or combinations of these co-reactants. Moreover, various additives, like accelerators, hardeners or other co-reactants, fillers, extenders or other components, of both synthetic or natural origin, but not restricted to these additives, may be present beside of the formaldehyde based condensation adhesive resin.

Preferably, the moisture is added to the wood particles in step b) in a state in which the wood particles are let to free fall by gravity, in particular while falling down over a height of 0.5 m to 3.5 m and more particularly over a height of 1 m to 3 m. For wood strands, a falling height of 2 m-3.5 m is particularly useful. This is a convenient way of distributing a continuous stream of wood particles and providing access to the wood particles from substantially all directions in order to evenly moisturize the wood particles. The specified height is sufficient for providing an appropriate amount of water in the wood particles such as strands for curing the binder in the subsequent production steps such as the pressing of oriented strand boards.

Preferably, the moisture is added in step b) by spraying water in the form of droplets or vapor from at least two different principal azimuthal directions on to the wood particles, the principal directions in particular being offset with respect to each other by an offset angle of at least 90°. This configuration provides even moisturizing after a short distance of free falling. The azimuth as a measure for lateral orientation may be defined with respect to an arbitrary lateral direction such as the discharge direction of the wood particles from the moisturizing device. In other words, according to the invention, the azimuth or azimuthal difference is used to define various spraying directions with respect to each other within a horizontal plane (when seen in a top view).

Preferably, the wood particles are subjected to turbulence in step b) by spraying water drops, water vapor and/or compressed air upwardly toward the wood particles while they are let to free fall by gravity. Thus, the dwelling time of the wood particles for moisturizing is increased and the particles are distributed more evenly and change position with respect to the propagation directions of the water drops or vapor more often.

Preferably, the wood particles are moisturized before entering the blending device. Such a configuration can be implemented easily in many existing production plants.

Preferably, at least one blending additive is added to the wood particles while they are let to free fall by gravity. Thus, the dwelling time inside the moisturizing device can be used in a particular efficient manner. Wax emulsions might be used as blending additive.

Preferably, 0.05 to 0.2 kg water per kg of wood particles is added in step b). This is a particularly useful range for strands used for the production of OSB (i.e. 50-200 Kg water per ton atro).

The object of the invention is also achieved with a method for the manufacturing of a lignocellulosic product, in particular a chip board, oriented strand board or fiber board, the method comprising the gluing method according to the invention and a step of forming the lignocellulosic product by pressing and curing the glued wood particles. Thus, the lignocellulosic product can be produced economically and with superior quality.

The object of the invention is also achieved with an apparatus comprising: a blending device for blending the wood particles with a water-curable binder, in particular with an isocyanate, and more particularly with polymeric diphenylmethane diisocyanate; and a moisturizing device for adding moisture to the wood particles outside the blending device.

In a preferred embodiment, the moisturizing device has at least one, preferably vertical, moisturizing channel in which the wood particles are let to fall free by gravity, the moisturizing channel in particular having a height of 0.5 m to 3.5 m or a height of 1 m to 3 m. For wood strands, a falling height of 2 m-3.5 m is particularly useful. Thus, the wood particles can be moisturized from the wall of the channel while moving through the channel. In contrast to a rotating blending drum, the channel can be particularly adapted to evenly adding a desired amount of moisture to the wood particles.

In a further preferred embodiment, a rotatable spreading device is provided over the moisturizing channel for spreading the wood particles before entering the moisturizing channel. Thus, the wood particles can be evenly distributed before falling into the moisturizing channel so that moisturizing can be performed at a minimum dwell time of the wood particles inside the moisturizing device.

Preferably, the moisturizing device comprises moisturizing outlets in the form of nozzles or sprayers for directing water in the form of drops or vapor onto the wood particles. In particular, the moisturizing outlets can be provided on the walls of the moisturizing device such that they laterally surround a continuous stream of wood particles to be moisturized. Thus, the wood particles can be evenly moisturized while passing the moisturizing outlets.

In a preferred embodiment, the moisturizing outlets are arranged in at least two moisturizing stages stacked on each other, each stage comprising at least two moisturizing outlets angularly offset with respect to each other such that the water is directed from at least two different principal azimuthal directions onto the wood particles. The moisturizing stages can be realized by ring-shaped nozzle assemblies. The number of stages can easily be adapted to the desired moisturizing amount. Thus, the moisturizing channel can be realized by a stack of identical nozzle assemblies, thereby reducing the cost for adapting the moisturizing device to different products and/or production capacities. Moisturizing outlets provided at different azimuths allow for a circumferentially even distribution of moisture within the moisturizing channel.

Preferably, at least two adjacent moisturizing stages are offset with respect to each other by an azimuthal difference, in particular by an azimuthal difference of 30° to 90°. This is a simple and efficient way of providing nozzles or sprayers at a plurality of different azimuths or, in other words, lateral spraying directions around the stream of wood particles.

In a preferred embodiment, at least four moisturizing outlets are angularly offset with respect to each other such that the water is directed from at least four different principal azimuthal directions onto the wood particles. Thus, a stream of wood particles can be evenly moisturized. Some or all moisturizing outlets can further be oriented upwardly to direct a medium such as water, compressed air or vapor into the moisturizing channel for adding turbulence and thus dwell time therein during moisturizing.

In another preferred embodiment, the moisturizing device further comprises additive outlets in the form of nozzles or sprayers for adding a blending additive to the wood particles. Thus, the additive, such as a wax emulsion, can be added without the need for a separate treatment station so that the apparatus can be made compact and costs can be saved.

Preferably, the blending device is arranged downstream or upstream of the moisturizing device. Thus, moisture can be applied uniformly and economically before the wood particles such as strands enter the blending device. Alternatively, the moisture can be added by the same technical means after the glued strands exit the blender. This embodiment also leads to the desired results and improvements.

Preferably, the cross-section of the moisturizing channel is substantially circular or rectangular. Circular channels are superior with respect to an even distribution of the wood particles over the cross-section and uniform spraying distances at different parts of the cross-sectional area. Rectangular or square cross-sections can be easily manufactured from steel sheets and can be easily adapted to conveyers or connecting product channels.

In a preferred embodiment, the blending device comprises a rotatable blending drum. This type of blender, resembling a tumbler, is routinely used for the production of oriented strand boards and be combined with the moisturizing device of the invention in a particular efficient manner.

Figure 2:
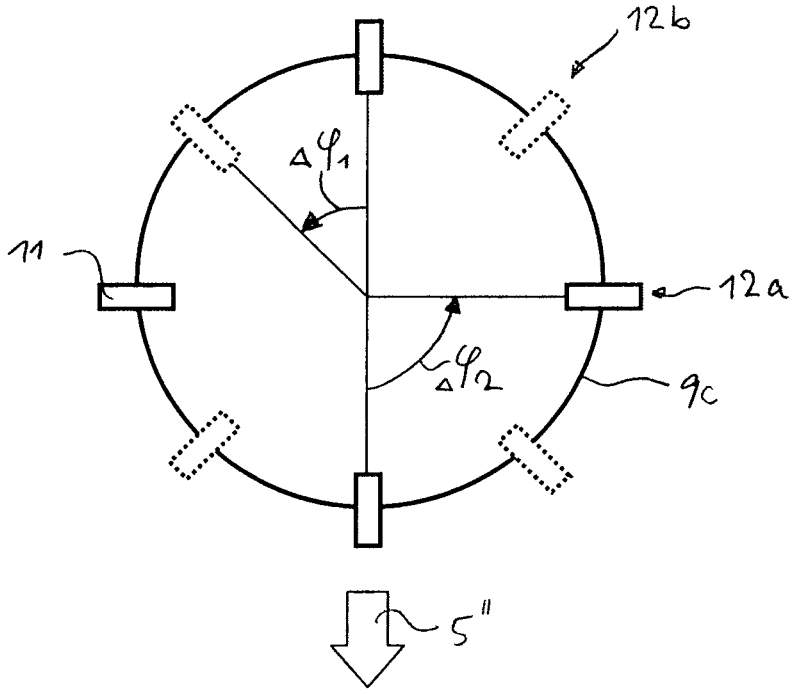
Figure 3:
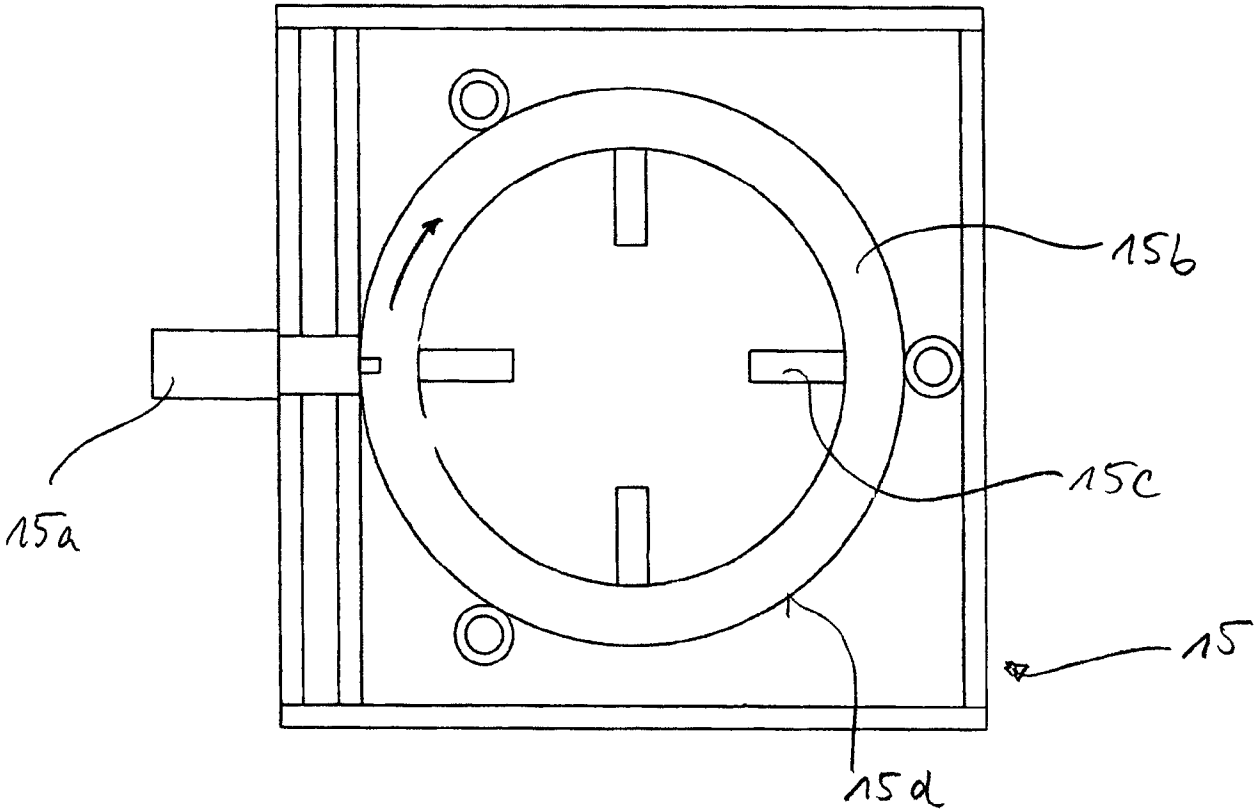

Preferred embodiments of the invention are illustrated in the drawing. The following are shown:

FIG. 1 a schematic lateral view of a gluing apparatus according to a first embodiment of the invention;

FIG. 2 a schematic cross-section of a moisturizing channel used in the invention;

FIG. 3 a schematic top view of the first embodiment; and

Figure 4:
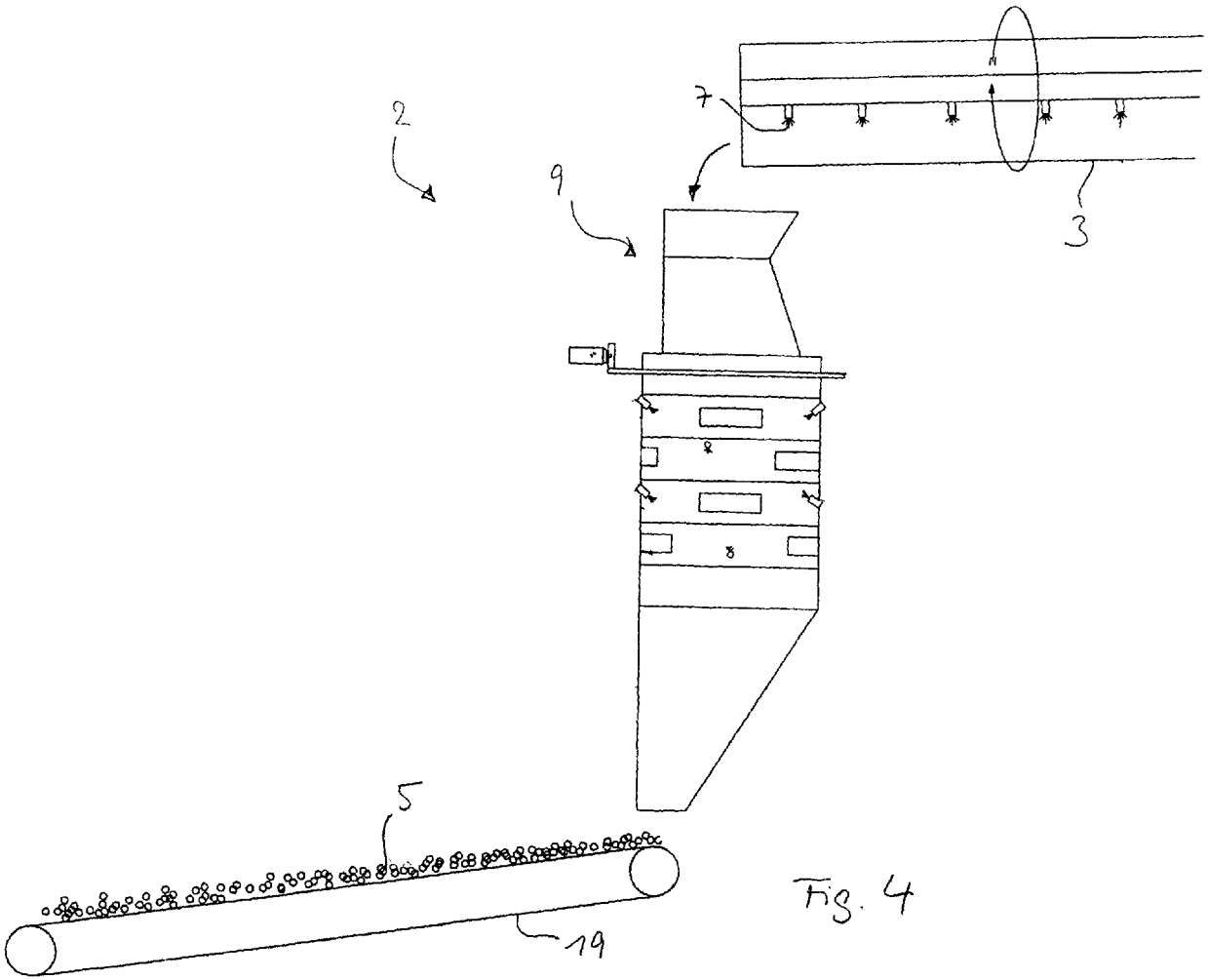

FIG. 4 a schematic lateral view of a gluing apparatus according to a second embodiment of the invention.

As can be seen from FIG. 1, the gluing apparatus 1 according to the invention comprises: a blending device 3, preferably a blender with a rotatable blending drum, for blending wood particles 5, in particular wood strands, with a water-curable binder 7, such as pMDI or melamine urea formaldehyde resin or the like; and a moisturizing device 9 for adding an appropriate amount of moisture to the wood particles 5 such that the binder 7 can be cured in a subsequent production step, preferably during heating and pressing of the glued wood particles 5 in a known manner, thereby producing lignocellulosic products such as OSB from the wood particles 5. However, chip boards or fiber boards could be produced as well.

In the embodiment of FIG. 1, the moisturizing device 9 is provided upstream of, and basically upside the blending device 3. The moisturizing device 9 comprises an upper entrance section 9*a* for feeding the wood particles 5 into the moisturizing device 9, a distributing section 9*b* for evenly spreading the wood particles 5, a moisturizing channel 9*c* for adding moisture to the wood particles 5, and a lower chute 9*d* for discharging the moisturized wood particles 5 from the moisturizing device 9. The moisturizing channel 9*c*, which is preferably a vertical hose made of steel sheet or the like, is provided with a plurality of moisturizing outlets 11 such as nozzles or sprayers for directing water 13 in the form of droplets or vapor onto the wood particles 5 while they fall through the moisturizing channel 9*c* toward the chute 9*d*.

As can be seen from FIG. 1, the moisturizing outlets 11 can be provided within four ring assemblies stacked on each other, thereby constituting a plurality of moisturizing stages 12*a*-12*d* through which the wood particles 5 have to fall. However, a plurality of moisturizing stages 12*a*-12*d* could also be provided in a single ring assembly. Moreover, the number of moisturizing stages 12*a*-12*d* is not limited to the shown embodiment.

Each moisturizing stage 12*a*-12*d* preferably comprises at least two moisturizing outlets 11 assigned to different circumferential segments of the moisturizing channel 9*c*. Preferably, at least four moisturizing outlets 11 are provided in each moisturizing stage 12*a*-12*d*.

However, as explained below, one or three moisturizing outlets 11 per stage 12*a*-12*d* might be sufficient as well, depending on the cross-section of the moisturizing channel 9*c* and the height 9*e* thereof.

As can be seen from FIG. 2, which schematically shows two stages 12*a* (solid lines) and 12*b* (broken lines) with four moisturizing outlets 11 each, adjacent moisturizing stages 12*a*-12*d* are preferably offset with respect to each other by an azimuthal difference (offset angle) $\Delta\phi_1$ corresponding to half the azimuthal difference (offset angle) $\Delta\phi_2$ between the moisturizing outlets 11 on the same stage 12*a*-12*d*. For example, in the case where four moisturizing outlets 11 are provided on each stage 12*a*-12*d* at an offset angle $\Delta\phi_2$ of 90° each, adjacent stages 12*a*, 12*b* would be offset with respect to each other by an angle $\Delta\phi_1$ of 45°. In doing so, the water 13 can be directed onto the wood particles 5 from eight different principal azimuthal directions. Of course, each of the moisturizing outlets 11 preferably spreads the water 13 in a diverging manner, the principal direction merely defining the orientation of the moisturizing outlet 11. Moreover, the offset angles $\Delta\phi_1$ and $\Delta\phi_2$ might vary from stage to stage and from nozzle to nozzle. They might be adapted to particular flow and/or spraying conditions inside the moisturizing channel 9*c* as well. The azimuthal directions may be defined with respect to an arbitrary lateral direction such as the discharge direction 5" of the wood particles 5 from the moisturizing device 9, as indicated in FIG. 2.

In the case where the moisturizing channel 9*c* has a square or rectangular cross-section, the moisturizing outlets 11 of one stage 12*a*-12*d* are preferably offset with respect to each other by an angle $\Delta\phi_2$ of 90° so that the wood particles 5 can be moisturized homogeneously from at least two lateral walls of the moisturizing channel 9*c*. In the case where the moisturizing channel 9*c* has a circular cross-section, the moisturizing outlets 11 of one stage 12*a*-12*d* could be offset with respect to each other, for example, by an angle $\Delta\phi_2$ of 90° (two or four outlets per stage), 120° (three outlets per stage) or 180° (two outlets per stage). However, other cross-sections of the moisturizing channel 9*c* are possible as well, such as various polygonal cross-sections. In general, square or rectangular cross-sections are desirable because such moisturizing channels 9*c* can be economically realized with a hose of steel sheet.

The moisturizing outlets 11 may be vertically inclined with respect to the transport direction 5' of the wood particles 5 inside the moisturizing channel 9*c*. Preferably, the moisturizing outlets 11 are inclined upwardly so that the sprayed water 13 creates turbulence inside the moisturizing channel 9 in order to spread the wood particles 5 more evenly and to prolong the dwell time of the wood particles 5 inside the moisturizing channel 9*c*. However, as shown in FIG. 1, some of the moisturizing outlets 11 could be inclined downwardly as well.

Basically, the wood particles 5 are let to free fall by gravity inside the moisturizing channel 9*c* over a predetermined height 9*e*, which is preferably in the range of 0.5 m to 3 m, depending on the type of wood particles 5 and the desired dwell time in the moisturizing channel 9*c*. In particular for wood strands, a height 9*e* of 2 m to 3.5 m is desirable. However, as can be deduced from the described turbulence that may additionally be created inside the moisturizing channel 9*c*, the term "free falling" must not be limited to the case where no other accelerating forces than the gravitational force act upon the wood particles 5. Instead, the term "free falling" indicates that the wood particles 5 are accessible from basically all directions while falling down, other than wood particles transported on an inclined chute, a conveying belt, a series of rollers or the like. Additional turbulence and movement of the wood particles 5 could also be provided by directing compressed air or vapor into the moisturizing channel 9*c*.

As can be seen from FIGS. 1 and 3, a rotatable spreading device 15 is provided at the distributing section 9*b* above the moisturizing channel 9*c*. The spreading device 15 comprises a motor 15*a*, a turning ring 15*b* and shovels 15*c* extending inwardly from the turning ring 15*b* which can be rotated such that the velocity at the outer circumference 15*d* thereof is 0 to 25 m/min, and more preferably 10 m/min to 25 m/min for spreading wood strands. The motor 15*a* may be electrically, hydraulically or pneumatically driven and preferably includes a gear. The spreading device 15 is configured to evenly distribute the wood particles 5 falling down from the product entrance 9*a* over the cross-sectional area of the moisturizing channel 9*c*. However, the spreading device 15 is not mandatory for the function of the invention, in particular if additional turbulence is produced inside the moisturizing channel 9*c*, as described above.

For the sake of completeness, an endless feeding conveyer belt 17 is shown in FIG. 1. However, the type of conveyer used for providing and discharging the wood particles 5 is not important for the function of the present invention. However, it is clear that the conveyer belt 17 is provided at an increased height as compared to the prior art so that the wood particles 5 can fall from the conveyer belt 17 through the moisturizing device 9 to an entrance section 3*a* of the blending device 3. Preferably the lower chute 9*d* is directly coupled to the entrance section 3*a* of the blending device 3.

As can be seen from FIG. 4, in an alternative embodiment 2 of the invention, the moisturizing device 9 could be arranged downstream of the blending device 3 as well. In this case, a discharge conveyer belt 19 is shown downstream of the moisturizing device 9. The moisturizing device 9 basically corresponds to the one described with respect to the first embodiment so that identical or equivalent parts are not designated in FIG. 4. It is essential for the invention that the wood particles 5 are moisturized outside the blending device 3 in order to avoid curing of the binder 7 inside the blending device 3. In doing so, maintenance of the blending device 3, in particular cleaning, can be minimized, thereby increasing the overall production capacity of the apparatus 1.

Moreover, the wood particles 5 can uniformly and exactly be moisturized in the moisturizing channel 9*c* so that unwanted blistering during forming of the end products can be reduced. As a consequence, pressing of the end products can be performed faster, thereby additionally increasing the production capacity.

The apparatus according to the invention can be used as follows:

Wood particles 5 or strands or the like are transported continuously on the conveyer belt 17 or the like to a height exceeding the entrance of the blending device 3. The wood particles 5 or strands or the like are let to free fall by gravity through the turning ring 15*b* into the moisturizing channel 9*c*, wherein 50 to 200 kg water per ton of strands are sprayed onto the wood particles, in particular strands, by moisturizing stages 12*a*-12*d* from eight different azimuthal directions. This has the major advantage that the tumbling wood particles 5 are evenly moisturized with an appropriate amount of water to contribute later to the curing process. A free fall height 9*e* of 0.5 to 3.5 meters and especially a height 9*e* of 1 to 3 meters are particularly useful. For wood strands, the height 9*e* is preferably in the range of 2 to 3.5 m.

The glued wood particles can eventually be transferred to a pressing station, wherein the wood particles are pressed and cured, thereby forming a lignocellulosic product such as an oriented strand board.

The invention is particularly useful in the case where isocyanates, and more particularly pMDI is used as a water-curable binder.

However, as described in detail below, various chemicals could be used as adhesives in connection to this invention and no limitation in principle in the selection of the adhesive used is given, as long as the adhesive can be get into contact with water or can be in contact with water or, in particular, water is even a part of the adhesive or adhesive mix used during the application onto the wood material. Adhesives which could be used for the production of lignocellulosic products can be, among others and not restricted to them, so-called adhesive condensation resins based on formaldehyde and on one or several members out of the group containing urea, melamine, phenol, resorcinol, tannins of different chemical behavior, origin, and properties, or other chemical moieties containing amino and amide functionalities, but not being restricted to only these components. Other suitable adhesives are formaldehyde containing resin adhesives as described above also containing other components, especially also components based on natural resources like lignins of various origin, composition, and properties, or protein components again of various origin, composition, and properties.

The isocyanate group (—NCO) of adhesives are reported usually as diphenylmethane diisocyanate (MDI) or pMDI, but not necessarily limited to this special type of isocyanate adhesive. Finally combinations in physical form (mixes) or in chemical form (co condensation) or combined types of adhesives might be used as well. Also addition of any form of fillers or extenders or similar ingredients influencing behavior of the adhesives, such as viscosity or flow ability or solid content, but not restricted to these features are suitable adhesives in sense of this invention. Additionally physical mixes or chemically reacting combinations or both physically and chemically combinations might be used.

The solidification of the adhesive forming the necessary cohesive bond strength is achieved by reaction types of polycondensation or polyaddition or other types of reactions yielding polymeric state of the adhesive, often called as hardening or gelling but not restricted to these two terms, whereby this solidification usually, but not for all types of adhesives, also is accompanied by the loss of water out of the adhesive or adhesive mix by penetration into the wood material or be evaporation at different temperatures and in different degree to the surrounding atmosphere.

The wood material in connection to this invention is not restricted in any size or shape as long as it is equal or similar to material usually described as strands or particles or chips or fibers or other adequate terms.

The invention claimed is:

1. A method for gluing wood particles for the manufacturing of lignocellulosic products, the method comprising the steps of:

a) blending the wood particles in a blending device with a water-curable binder; and b) adding moisture to the wood particles in at least one moisturizing channel of a moisturizing device outside the blending device in a state in which the wood particles are let to free fall by gravity, wherein the wood particles are laterally spread by a rotatable spreading device before they enter the moisturizing device, the rotatable spreading device being arranged above the moisturizing channel.

2. The method according to claim 1, wherein the moisture is added in step b) by spraying water in the form of droplets or vapor from at least two different principal azimuthal directions on to the wood particles.

3. The method according to claim 1, wherein the wood particles are subjected to turbulence in step b) by spraying at least one of water drops, water vapor and compressed air upwardly toward the wood particles while they are let to free fall by gravity.

4. The method according to claim 1, wherein the wood particles are moisturized before entering the blending apparatus.

5. The method according to claim 1, wherein at least one blending additive is further added to the wood particles while they are let to free fall by gravity.

6. The method according to claim 1, wherein 0.05 to 0.2 kg water per kg wood particles is added in step b).

7. The method according to claim 1, further comprising:

pressing and curing the glued wood particles to form the lignocellulosic product.

8. An apparatus for gluing wood particles for the manufacturing of lignocellulosic products, the apparatus comprising:

a blending device for blending the wood particles with a water-curable binder;

a moisturizing device for adding moisture to the wood particles outside the blending device, the moisturizing device having at least one moisturizing channel in which the wood particles are let to fall free by gravity, and a rotatable spreading device, the rotatable spreading device being arranged above the moisturizing channel to spread the wood particles laterally before the wood particles enter the moisturizing channel.

9. The apparatus according to claim 8, wherein the cross-section of the moisturizing channel is substantially circular or rectangular.

10. The apparatus according to claim 8, wherein the moisturizing device comprises moisturizing outlets in the form of nozzles or sprayers for directing water in the form of droplets or vapor onto the wood particles.

11. The apparatus according to claim 10, wherein the moisturizing outlets are arranged in at least two moisturizing stages stacked on each other, each stage comprising at least two moisturizing outlets angularly offset with respect to each other such that the water is directed from at least two different principal azimuthal directions onto the wood particles.

12. The apparatus according to claim 11, wherein at least two adjacent moisturizing stages are offset with respect to each other by an azimuthal difference of 30° to 90°.

13. The apparatus according to claim 10, wherein the moisturizing device comprises at least four moisturizing outlets, the moisturizing outlets being angularly offset with respect to each other such that the water is directed from at least four different principal azimuthal directions onto the wood particles.

14. The apparatus according to claim 8, wherein the moisturizing device further comprises additive outlets in the form of nozzles or sprayers for adding a blending additive to the wood particles.

15. The apparatus according to claim 8, wherein the blending device is arranged downstream or upstream of the moisturizing device.

16. The apparatus according to claim 8, wherein the blending device comprises a rotatable blending drum.

17. The method of claim 1, wherein the wood particles are wood strands.

18. The method of claim 1, wherein the lignocellulosic products are chip boards, oriented strand boards or fiber boards.

19. The method of claim 1, wherein the water-curable binder is an isocyanate binder.

20. The method of claim 19, whereon the binder is a polymeric diphenylmethane diisocyanate binder.

21. The method according to claim 1, wherein, in step b), the moisture is added to the wood particles in a state in which the wood particles are let to free fall by gravity while falling down over a height of 0.5 m to 3.5 m.

22. The method according to claim 1, wherein, in step b), the moisture is added to the wood particles in a state in which the wood particles are let to free fall by gravity while falling down over a height of 1 m to 3 m.

23. The method according to claim 2, wherein the at least two different principal azimuthal directions are offset with respect to each other by an offset angle of at least 90°.

24. The apparatus according to claim 8, wherein the moisturizing channel is vertical.

25. The apparatus according to claim 24, wherein the vertical moisturizing channel has a height between 0.5 m and 3.5 m.

26. The apparatus according to claim 24, wherein the vertical moisturizing channel has a height between 1 m and 3 m.

* * * * *